US011017726B2

(12) United States Patent
Kim

(10) Patent No.: US 11,017,726 B2
(45) Date of Patent: May 25, 2021

(54) DISPLAY METHOD AND METHOD OF DRIVING THE SAME

(71) Applicant: LG Display Co., Ltd., Seoul (KR)

(72) Inventor: Dosung Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/567,948

(22) Filed: Sep. 11, 2019

(65) Prior Publication Data

US 2020/0082766 A1 Mar. 12, 2020

(30) Foreign Application Priority Data

Sep. 12, 2018 (KR) ..... 10-2018-0109262

(51) Int. Cl.
*G09G 3/3275* (2016.01)
*G09G 3/20* (2006.01)

(52) U.S. Cl.
CPC ..... *G09G 3/3275* (2013.01); *G09G 3/2003* (2013.01); *G09G 2310/027* (2013.01); *G09G 2310/0291* (2013.01); *G09G 2310/0294* (2013.01); *G09G 2310/08* (2013.01)

(58) Field of Classification Search
CPC .. G09G 3/3275; G09G 3/2003; G09G 3/2096; G09G 2310/027; G09G 2310/0294; G09G 2310/0291; G09G 2310/08
See application file for complete search history.

(56) References Cited

U.S. PATENT DOCUMENTS 7,205,972 B1 * 4/2007 Kyeong ..... G09G 3/3648 345/100
2007/0002669 A1 * 1/2007 Kodaira ..... G09G 3/20 365/230.06
2007/0120781 A1 * 5/2007 Choi ..... H03M 1/765 345/76
2008/0042946 A1 * 2/2008 Park ..... G09G 3/3275 345/82
2016/0365058 A1 * 12/2016 Nam ..... G09G 3/3614

FOREIGN PATENT DOCUMENTS

KR 10-2006-0018766 A 3/2006

* cited by examiner

*Primary Examiner* — Brent D Castiaux
(74) *Attorney, Agent, or Firm* — Fenwick & West LLP

(57) ABSTRACT

A display device comprises: a panel comprising a pixel array; a data driver for outputting video data signals to the panel; and a latch part for receiving the video data signals from the data driver and outputting the received video data signals to the pixel array. With this configuration, the number of data drive ICs of the data driver can be reduced while maintaining the panel driving frequency.

10 Claims, 9 Drawing Sheets

<Waveforms of line memory data transmission>

<Waveforms of DIC operation>

[Waveforms of latch part]

DISPLAY METHOD AND METHOD OF DRIVING THE SAME

CROSS-REFERENCE TO RELATED APPLICATION

This application claims the benefit of Korean Patent Application No. 10-2018-0109262, filed on Sep. 12, 2018, which is incorporated herein by reference for all purposes as if fully set forth herein.

BACKGROUND OF THE INVENTION

Field of the Invention

The present invention relates to a display device and a method of driving the same.

Related Art

The market for displays which act as an intermediary between users and information is growing with the development of information technology. Thus, display devices such as organic light-emitting displays (OLED), and quantum dot displays (QDP), liquid-crystal displays (LCD) are increasingly used.

Examples of the display devices include liquid crystal displays (LCD), plasma display panels (PDP), organic light-emitting diode displays, etc. Notably, an active-matrix organic light-emitting display comprises organic light-emitting diodes (hereinafter, OLEDs) which emit light by themselves, and has the advantages of fast response time, high luminous efficiency, high luminance, and wide viewing angle.

A display device comprises a display panel comprising sub-pixels, a drive part that outputs driving signals for driving the display panel, and a power supply part that supplies electric power to the display panel or drive part. The display device is capable of displaying an image by supplying driving signals, for example, a scan signal and a data signal, to the sub-pixels formed on the display panel and allowing selected sub-pixels to pass light through them or emit light by themselves. With the increased use of such display devices, there are various ongoing studies being conducted to improve the structure and performance of display devices.

One of the methods to improve the structure and performance is to reduce the number of data drive ICs. However, in the conventional art, the reduction in the number of data drive ICs has inevitably led to an increase in the driving speed of the display panel and an increase in the number of gate lines.

SUMMARY OF THE INVENTION

A display device and a method of driving the same according to the embodiments herein are capable of reducing the number of data drive ICs while maintaining the configuration, such as the driving speed of the display panel and the number of gate lines. An exemplary embodiment of the present invention provides a display device comprising: a panel comprising a pixel array; a data driver for outputting video data signals to the panel; and a latch part for receiving the video data signals from the data driver and outputting the received video data signals to the pixel array.

The latch part may align and output the video data signals received from the data driver as 1 horizontal line of data signals corresponding to 1 horizontal line on the pixel array. Specifically, the latch part receives the video data signals corresponding to one horizontal line of the pixel array during different time intervals within one horizontal period and outputs the video data signals corresponding to the one horizontal line of the pixel array aligned.

The latch part may sequentially receive and store 1/N video data signals during each 1/N horizontal period of the one horizontal period, and output one full horizontal line of the video data signals stored during the one horizontal period aligned, to a data line on the pixel array.

The latch part may store video data signals of first color during a 1/4th horizontal period, store video data signals of second color during a 2/4th horizontal period, store video data signals of third color during a 3/4th horizontal period, and store video data signals of fourth color during a 4/4th horizontal period, and output the stored video data signals of first, second, third, and fourth colors aligned.

The latch part may comprise: sampling latches which sequentially receive and output the video data signals; hold latches which sequentially store the video data outputted from the sampling latches and output the stored video data upon receipt of a load signal; and buffers which deliver the outputs of the hold latches to a data line on the pixel array.

The display device may further comprise a timing controller that time-divides 1 horizontal line of digital video data into N parts, store each part as 1/N digital video data, and output the 1/N digital video data to the data driver in synchronization with a corresponding 1/N horizontal period.

The data driver may convert the 1/N digital video data to analog video data signals and output the analog video data signals to the latch part.

The data driver may comprise one or more data drive ICs.

In another aspect, the present invention provides a method of driving a display device, the method comprising: outputting video data from a timing controller to a data driver; converting the received video data to analog video data signals and outputting the analog video data signals by the data driver; and receiving and storing the analog video data signals and outputting the analog video data signals to a pixel array of a display panel by a latch part on the display panel.

The outputting of video data from the timing controller to the data driver may comprise: time-dividing 1 horizontal line of digital video data into N parts and storing each part as 1/N digital video data; and outputting the 1/N digital video data to the data driver in synchronization with a corresponding 1/N horizontal period.

The receiving and storing of the analog video data signals and outputting the analog video data signals to the pixel array by the latch part may comprise: sequentially receiving and storing 1/N video data signals during each 1/N horizontal period, and outputting 1 horizontal line of video data signals stored during 1 horizontal period. Specifically, the receiving and storing of the analog video data signals and outputting the analog video data signals to the pixel array by the latch part may comprise receiving the analog video data signals corresponding to one horizontal line of the pixel array during different time intervals within one horizontal period and outputting the analog video data signals corresponding to the one horizontal line of the pixel array aligned.

According to an exemplary embodiment of the present invention, a latch circuit for sampling and holding data is implemented within a display panel, so that data outputted from data drive ICs is latched within the display panel and realigned and outputted as 1 horizontal line of data. As such, even if the number of data drive ICs is reduced, the latch circuit can output 1 horizontal line of data in parallel at the same rate as the conventional art. Therefore, the number of data drive ICs can be reduced while maintaining the same panel driving rate and gate line structure as before.

According to an exemplary embodiment of the present invention, a large-area display allows for driving a large-area pixel array without additional data drive ICs, even with an increase in the number of pixel arrays.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DESCRIPTION OF EXEMPLARY EMBODIMENTS

Figure 1:
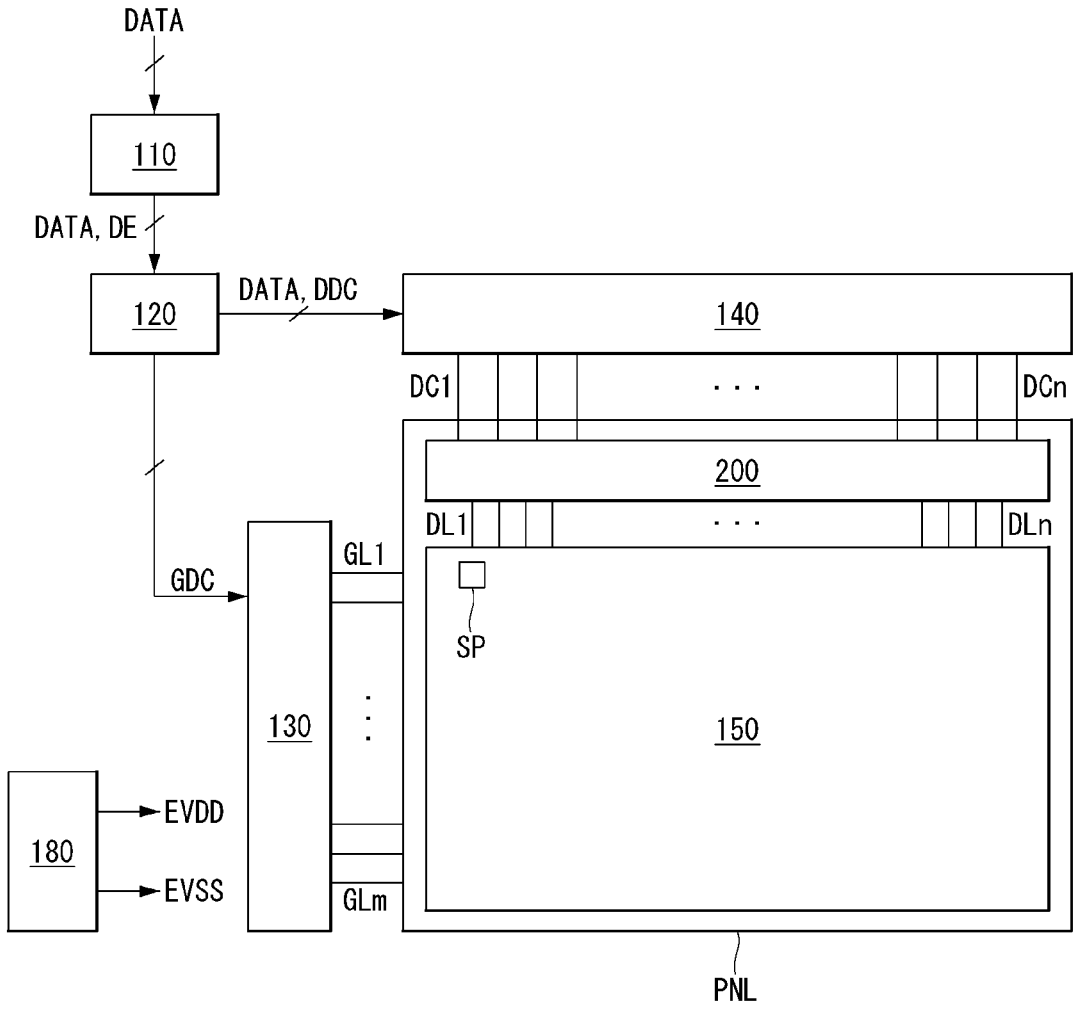
FIG. 1 is a schematic block diagram of a display device according to an exemplary embodiment of the present invention.

Various aspects and features of the present invention and methods of accomplishing them may be understood more readily by reference to the following detailed descriptions of exemplary embodiments and the accompanying drawings. The present invention may, however, be embodied in many different forms and should not be construed as being limited to the exemplary embodiments set forth herein. Rather, these exemplary embodiments are provided so that this disclosure will be thorough and complete and will fully convey the concept of the present invention to those skilled in the art, and the present invention is defined by the appended claims.

The shapes, sizes, proportions, angles, numbers, etc. shown in the figures to describe the exemplary embodiments of the present invention are merely examples and not limited to those shown in the figures. Like reference numerals denote like elements throughout the specification. In describing the present invention, detailed descriptions of related well-known technologies will be omitted to avoid unnecessary obscuring the present invention. When the terms 'comprise', 'have', 'consist of' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms "on", "over", "under", "next to" and the like, one or more parts may be positioned between the two parts as long as the term "immediately" or "directly" is not used.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

Throughout the specification, like reference numerals denote substantially like components.

In the present specification, a pixel circuit and gate driver formed on a substrate of the display panel may be implemented as an n-type MOSFET (metal oxide semiconductor field-effect transistor) TFT, but is not limited thereto and may be implemented as a p-type MOSFET TFT. A TFT is a three-electrode device with gate, source, and drain. The source is an electrode that provides carriers to the transistor. The carriers in the TFT flow from the source. The drain is an electrode where the carriers leave the TFT. That is, the carriers in the TFT flow from the source to the drain. In the case of the n-type TFT (NMOS), the carriers are electrons, and thus the source voltage is lower than the drain voltage so that the electrons flow from the source to the drain. In the n-type TFT, current flows from the drain to the source since the electrons flows from the source to the drain. In contrast, in the case of the p-type TFT (PMOS), the carriers are holes, and thus the source voltage is higher than the drain voltage so that the holes flow from the source to the drain. In the p-type TFT, current flows from the source to the drain since the holes flow from the source to the drain. However, it should be noted that the source and drain of a MOSFET are not fixed in position. For example, the source and drain of the MOSFET are interchangeable depending on the applied voltage. As such, in the description of an exemplary embodiment of the present specification, either the source or drain will be termed a first electrode, and the other of the source or drain will be termed a second electrode.

Hereinafter, an exemplary embodiment of the present specification will be described in detail with reference to the accompanying drawings. In the exemplary embodiment below, a description of a display device will be given with respect to an organic light-emitting display comprising organic light-emitting materials. However, it should be noted that the technical spirit of the present specification is not limited to organic light-emitting displays, but may be applied to an inorganic light-emitting display comprising inorganic light-emitting materials.

In describing the present invention, a detailed description of known functions or configurations related to the present invention will be omitted when it is deemed that they may unnecessarily obscure the subject matter of the present invention.

FIG. 1 is a schematic block diagram of a display device according to an exemplary embodiment of the present invention.

As shown in FIG. 1, the display device comprises an image processor 110, a timing controller 120, a gate driver 130, a data driver 140, and a pixel array 150.

The image processor 110 outputs a data enable signal DE, etc., along with externally supplied digital video data DATA. The image processor 110 may output one or more among a vertical synchronization signal, horizontal synchronization signal, and clock signal, in addition to the data enable signal DE, but these signals are not shown in the drawings for convenience of explanation.

The timing controller 120 receives the digital video data DATA from the image processor 110, along with the data enable signal DE or driving signals including the vertical synchronization signal, horizontal synchronization signal, and clock signal. Based on the driving signals, the timing controller 120 outputs a gate timing control signal GDC for controlling the operation timing of the gate driver 130 and a data timing control signal DDC for controlling the operation timing of the data driver 140.

The gate driver 130 outputs a scan signal, in response to the gate timing control signal GDC supplied from the timing controller 120. The gate driver 130 outputs a scan signal of scan-high voltage and scan-low voltage through gate lines GL1 to GLm. The gate driver 130 is formed in the form of a discrete IC (integrated circuit), or is formed on the pixel array 150 itself by a gate-in-panel (GIP) technology.

In response to the data timing control signal DDC supplied from the timing controller 120, the data driver 140 converts the digital video data DATA supplied form the timing controller 120 in the form of voltage signal based on gamma reference voltage and outputs an analog video data signal. The data driver 140 outputs video data signals through data channels DC1 to DCn. The data driver 140 may come in the form of one or more ICs (integrated circuits).

A panel PNL comprises a pixel array 150 that displays an image and a latch part 200 that realigns video data signals received from the data driver 140 and outputs them to data lines DL on the pixel array 150.

The pixel array 150 is a matrix of sub-pixels SP which work to display an image. The sub-pixels SP arranged on the same horizontal line may be commonly supplied with high-potential and low-potential driving voltages EVDD and EVSS and a reference voltage Vref.

The sub-pixels SP each may comprise an OLED. The OLED, which is a self-luminous element, comprises an anode, a cathode, and an organic compound layer situated between these electrodes. Each sub-pixel SP may be any one among a red sub-pixel SP, a green sub-pixel SP, a blue sub-pixel SP, and a white sub-pixel SP. The red sub-pixel SP, green sub-pixel SP, blue sub-pixel SP, and white sub-pixel SP may form a unit pixel for color representation. The circuit configuration of the sub-pixels SP may have many variations. For example, pixels PXL each may comprise at least two switching TFTs and at least one storage capacitor, in addition to an OLED and a driving TFT DT. The TFTs constituting each sub-pixel SP may be implemented as p-type, n-type, or a hybrid of the two. Semiconductor layers of the TFTs constituting each sub-pixel SP may comprise amorphous silicon, polysilicon, or oxide. The sub-pixels SP may comprise red sub-pixels, green sub-pixels, and blue sub-pixels, or may comprise white sub-pixels, red sub-pixels, green sub-pixels, and blue sub-pixels.

The latch part 200 sequentially stores video data signals supplied from the data driver 140 and aligns them as 1 horizontal line of data signals corresponding to 1 horizontal line on the pixel array 150, and then outputs them to the data lines DL1 to DLn on the pixel array 150. The latch part 200 may receive 1/N video data signals during each 1/N horizontal period and sequentially store them, and then output 1 horizontal line of video data signals stored during 1 horizontal period to data lines DL on the pixel array 150. For example, the latch part 200 may store W (white) video data signals during a 1/4th horizontal period, R (red) video data signals during a 2/4th horizontal period, G (green) video data signals during a 3/4th period, and B (blue) video data signals during a 4/4th horizontal period, and sequentially output the stored WRGB video data signals.

Here, the timing controller 120 may time-divide 1 horizontal line of digital video data into N parts, store each part as 1/N digital video data, and output the 1/N digital video data to the latch part 200 through the data driver 140 in synchronization with a corresponding 1/N horizontal period. 1 horizontal line of data is outputted once in each horizontal signaling cycle in the conventional art, whereas the data driver 140 of this exemplary embodiment may output 1/N data N times in each horizontal signal cycle and the latch part 200 may receive the data and realign it as 1 horizontal line of data.

Figure 2:
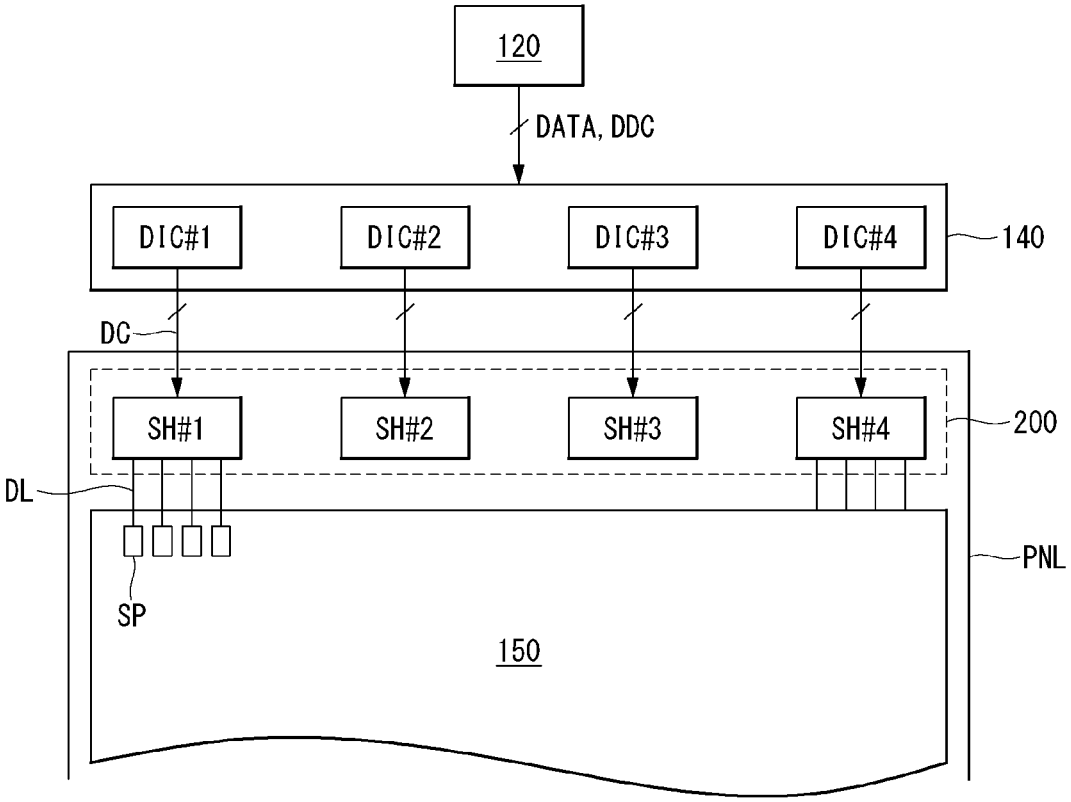
FIG. 2 is a schematic block diagram of a data driver and latch part of the display device shown in FIG. 1.

FIG. 2 is a is a schematic block diagram of a data driver and latch part of the display device shown in FIG. 1.

The data driver 140 may comprise one or more data drive ICs DIC. In this exemplary embodiment, the data driver 140 is illustrated as comprising four data drive ICs DIC #1 to DIC #4. Each of the data drive ICs DIC #1 to DIC #4 converts digital video data DATA from the timing controller 120 to positive/negative analog video data signals. The data drive ICs DIC #1 to DIC #4 transmit the analog video data signals to the latch part 200 on the panel PNL through n output channels DC1 to DCn.

The latch part 200 comprises latch blocks SH #1 to SH #4 each comprising a sampling latch and a hold latch. The latch part 200 sequentially stores the video data signals supplied from the data driver 140 through the latch blocks SH #1 to SH #4, realigns them in 1 horizontal line of video data signals, and then outputs them to the data lines DL1 to DLn on the pixel array 150. The latch part 200, together with the pixel array 150, may be formed in the panel PNL.

The timing controller 120 outputs digital video data DATA, which comprises W video data, R video data, G video data, and B video data, and a data timing control signal DDC to the data driver 140. The timing controller 120 according to the exemplary embodiment of the present invention controls the data driver 140 to operate four times faster than the existing data enable signal DE, so that 1 horizontal line of digital video data is divided into four and outputted four times faster. The latch part 200 sequentially stores the four separate parts of input data, realigns them as 1 horizontal line of data, and then outputs it to the pixel array 150.

Figure 3:
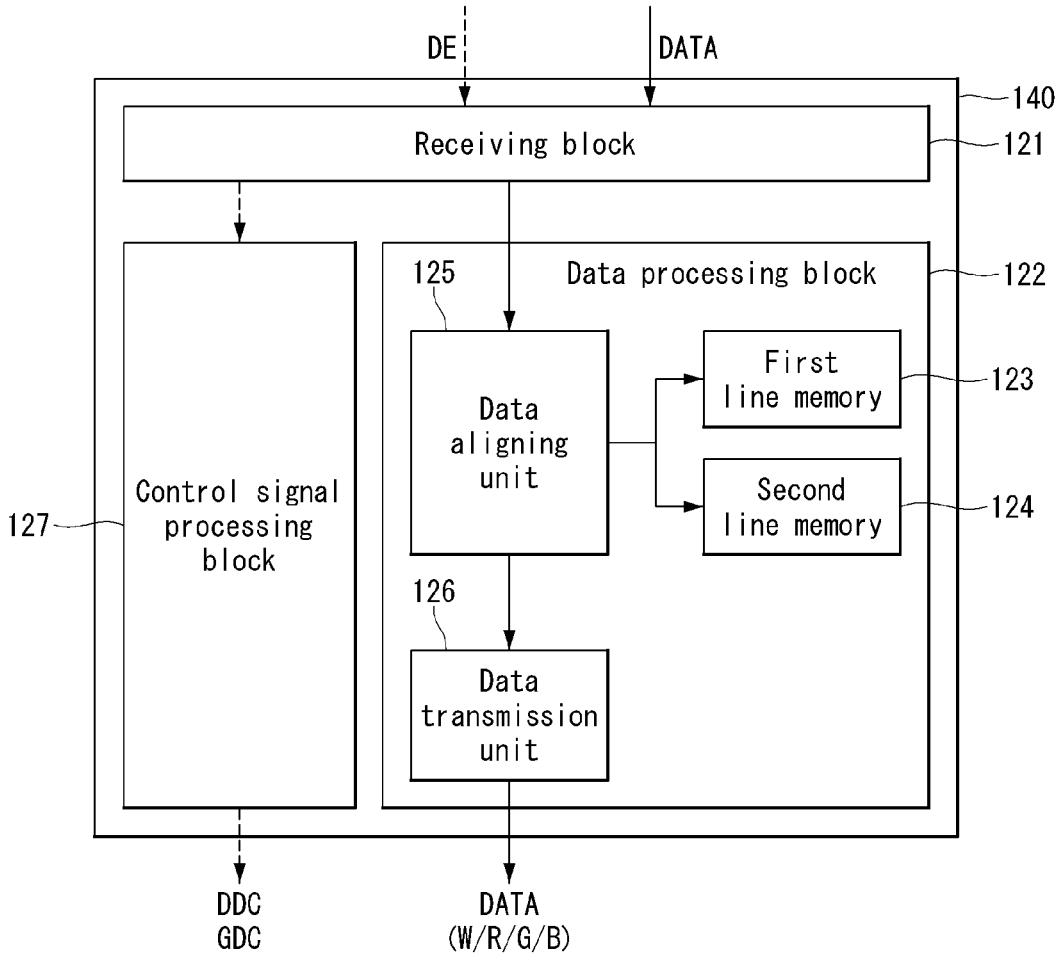
FIG. 3 is a control block diagram of a timing controller shown in FIG. 1 according to an embodiment.

FIG. 3 is a control block diagram of the timing controller according to an embodiment.

Referring to FIG. 3, the timing controller 120 comprises a receiving block 121 which receives external data, a control signal processing block 127 which generates a control signal, and a data processing block 122 which processes video data.

The timing controller 120 receives the digital video data DATA from the image processor 110 through the receiving block 121, along with the data enable signal DE or driving signals including the vertical synchronization signal, horizontal synchronization signal, and clock signal.

Based on the data enable signal DE or the vertical synchronization signal, horizontal synchronization signal, and clock signal, the timing controller 120 outputs a gate timing control signal GDC for controlling the operation timing of the gate driver 130 and a data timing control signal DDC for controlling the operation timing of the data driver 140.

The data processing block 122 divides the digital video data DATA received from the image processor 110 into N parts so that the data is transmitted to the data driver 140 at a rate N times faster. To this end, the data processing block 122 comprises a data aligning unit 125, a first line memory 123, a second line memory 124, and a data transmission unit 126.

The data aligning unit 125 divides the digital video data DATA received from the image processor 110 into N parts, and stores the N parts of digital video data in the first line memory 123 and second line memory 124. The first line memory 123 may store the 1/Nth and 2/Nth digital video data, and the second line memory 124 may store the 3/Nth and 4/Nth digital video data. The data aligning unit 125 outputs the digital video data stored in the line memories 123 and 124 at a rate N times faster. For example, when the received digital video data DATA is divided into four, the first line memory 123 may store the 1/4th and 2/4th digital video data, and the second line memory 124 may store the 3/4th and 4/4th digital video data. The data aligning unit 125 outputs the digital video data stored in the line memories 123 and 124 at a rate four times faster than in the conventional art.

The data transmission unit 126 outputs the N parts of digital image data stored in the line memories 123 and 124 to the data driver 140 under control of the data aligning unit 125.

With this configuration, the timing controller 120 may operate four times faster than the frequency of the existing data enable signal DE and output 1 horizontal line of digital video data during four time slots. The timing controller 120 outputs W digital video data, corresponding to 960 out of 3,840 signals of W/R/G/B included in 1 horizontal line of digital video data, during a 1/4th period, R digital video data corresponding to another 960 signals during a 2/4th period, G digital video data corresponding to another 960 signals during a 3/4th period, and B digital video data corresponding to the remaining 960 signals during a 4/4th period.

Upon receiving the digital video data from the timing controller 120, the data driver 140 converts the digital video data to video data signals of analog data voltage and outputs them to the latch part 200 on the panel PNL through n output channels DC1 to DCn.

Figure 4:
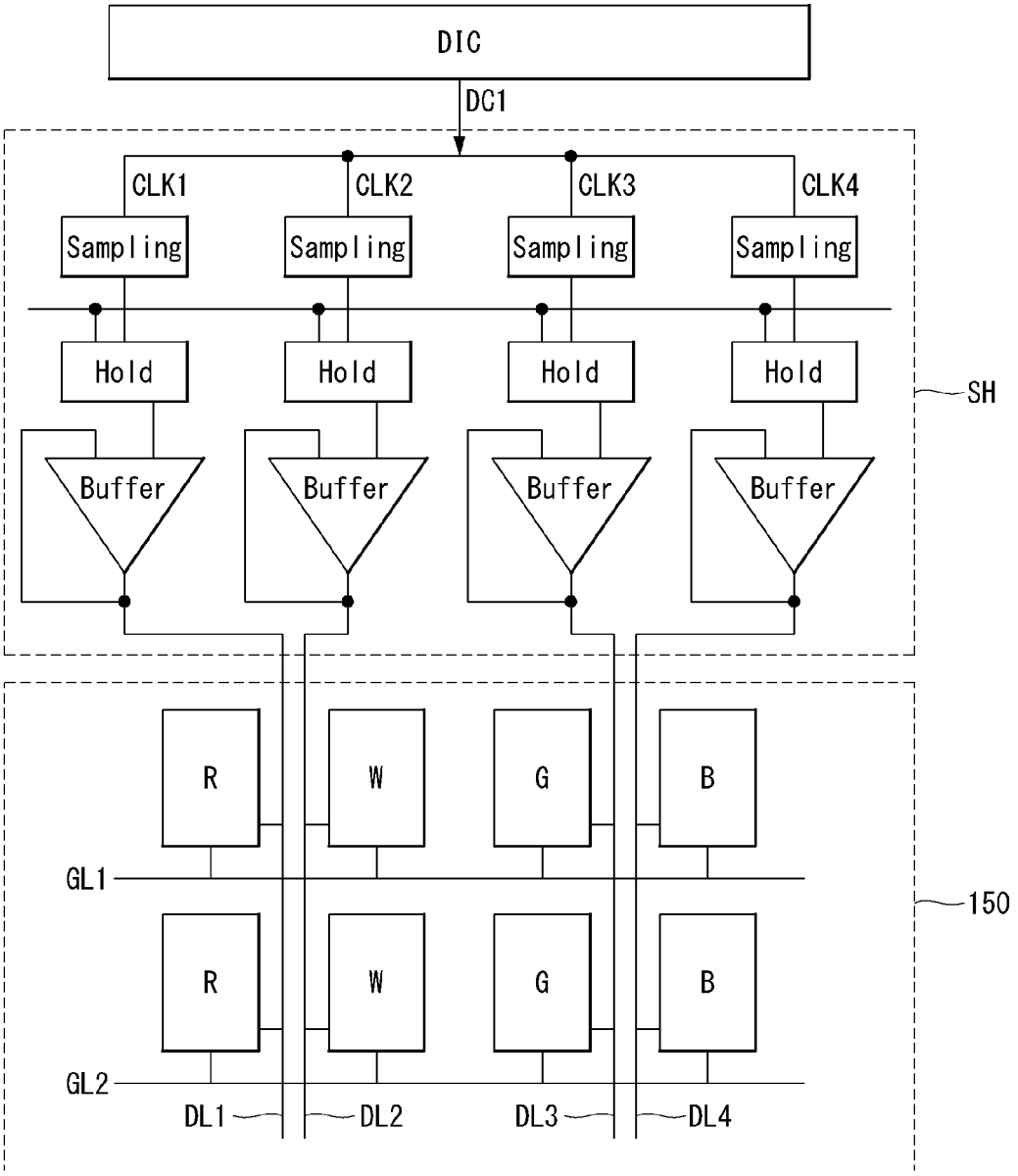
FIG. 4 is a schematic block diagram of the latch part and a pixel array according to an embodiment.

FIG. 4 is a schematic block diagram of the latch part 200 and pixel array 150 according to an embodiment.

Referring to FIG. 4, the latch part 200 comprises sampling latches, hold latches, and buffers, and outputs data signals to the data lines DL1 to DL4 on the pixel array 150. For example, the sample latches and hold latches SH shown in FIG. 4 may correspond to SH #1 of FIG. 2 receiving data signals from DIC #1.

The pixel array 150 may be implemented as a matrix of white (W), red (R), green (G), and blue (B) sub-pixels connected to gate lines GL and data lines DL.

The latch part 200 receives video data signals from the data driver 140, divides them into four parts, and sequentially stores them through the sampling latches and hold latches SH during four time slots of 1 horizontal signal period H. Referring to FIG. 4, in a case where the data drive ICs DIC #1 to DIC #4 are used and data is divided up into four parts that are transmitted separately, four sampling latches and hold latches SH may be used for each data drive IC DIC. Having received CLK1 during a 1/4th horizontal time, the first sampling latch and hold latch receives and stores W video data signals. Having received CLK2 during a 2/4th horizontal time, the second sampling latch and hold latch receives and stores R video data signals. Having received CLK3 during a 3/4th horizontal time, the third sampling latch and hold latch receives and stores G video data signals. Having received CLK4 during a 4/4th horizontal time, the fourth sampling latch and hold latch receives and stores B video data signals. Likewise, the sampling latches and holds latches SH (e.g., SH #2, SH #3, SH #4) connected to the remaining three data drive ICs DIC (e.g., DIC #2, DIC #3, DIC #4) also receive and store WRGB video data signals from the corresponding data drive ICs DIC.

With this configuration, after 1 horizontal time, 1 horizontal line of WRGB video data signals may be aligned and stored in the latch part 200. Afterwards, the stored data is supplied to the data lines DL1 to DLn on the pixel array 150 through the buffers, based on a load signal inputted to the hold latches.

As explained above, in the present invention, the latch part 200 is formed, together with the pixel array 150, within the panel PNL, and the latch part 200 stores and aligns N video data signals which are received separately during N time slots, combines them into a video data signal corresponding to 1 horizontal line, and outputs it to the pixel array 150. That is, instead of reducing the number of data drive ICs, 1/N of a video data signal corresponding to 1 horizontal line is transmitted N times, and the divided parts of the video data signal are realigned in the latch part 200 in the panel PNL and outputted to the pixel array 150. With this configuration, even if the number of data drive ICs is reduced, the pixel array 150 on the panel PNL may run at the same frequency with the same structure as the conventional art. If the driving frequency of the pixel array 150 on the panel PNL is increased, the number of scan lines also needs to be increased, which results in a decrease in aperture ratio. To solve this problem, the present invention is capable of reducing the number of data drive ICs while maintaining the panel driving frequency.

Figure 5:
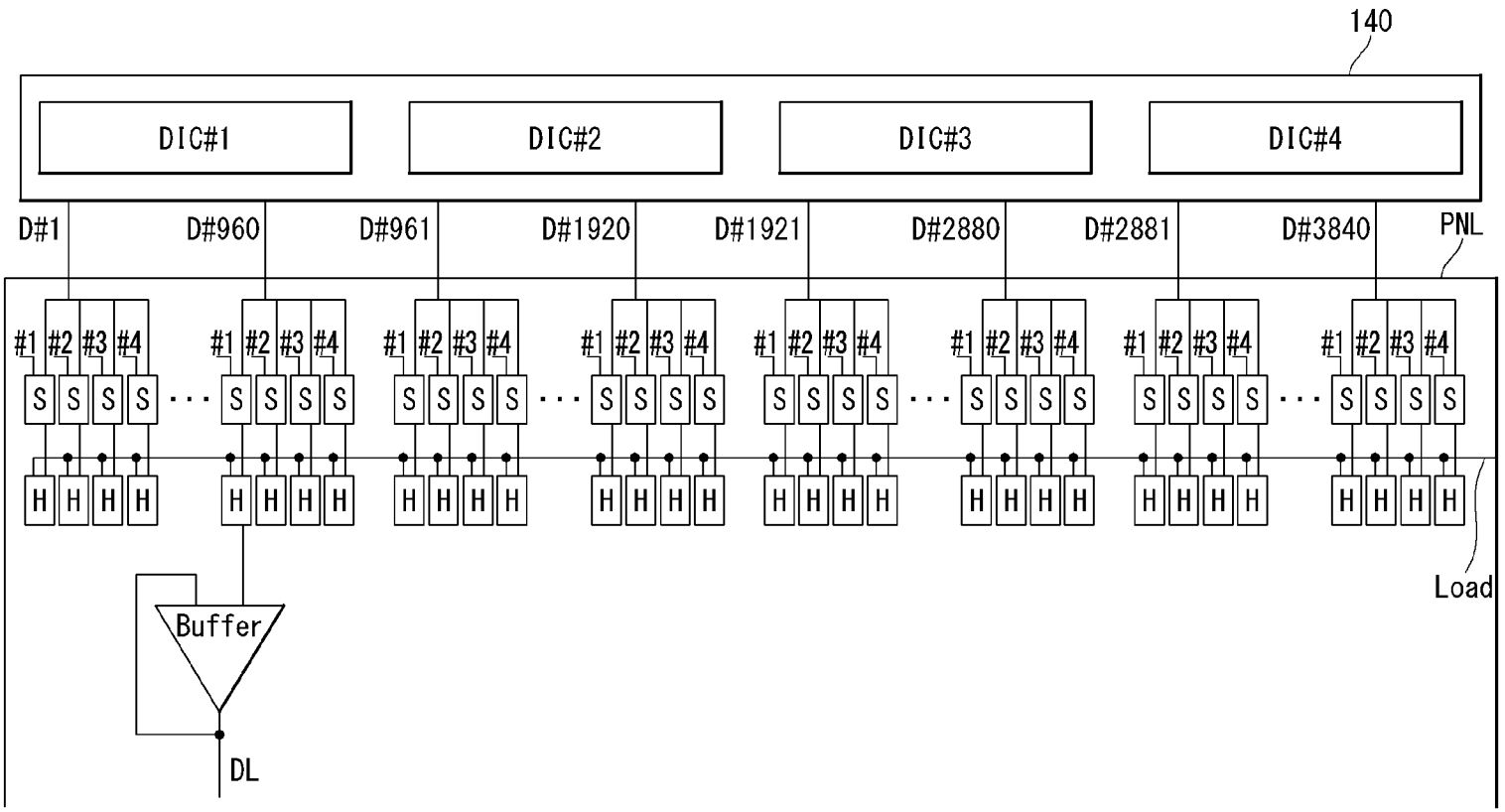
FIG. 5 is a schematic block diagram of the data driver and latch part according to an exemplary embodiment of the present invention.

A method of driving a display device according to an exemplary embodiment of the present invention will be described in detail with reference to FIGS. 5 to 9. FIG. 5 is a schematic block diagram of the data driver and latch part 200 according to an exemplary embodiment of the present invention. FIGS. 6 to 9 are signal waveform diagrams for explaining a method of driving a display device according to an exemplary embodiment of the present invention.

Referring to FIG. 5, the data driver 140 may comprise four data drive ICs DIC #1 to DIC #4. Each of the data drive ICs DIC #1 to DIC #4 converts digital video data DATA received from the timing controller 120 to positive/negative analog video data signals and outputs them to the latch part 200 in the panel PNL.

The latch part 200 comprises sampling latches S and hold latches H to sequentially store video data signals supplied from the data drive ICs DIC #1 to DIC #4.

The sampling latches S are enabled by CLK signals CLK1(#1), CLK2(#2), CLK3(#3), and CLK4(#4) and deliver the video data signals received from the data drive ICs DIC #1 to DIC #4 to the hold latches H. The hold latches H sequentially receive and store the video data signals from the sampling latches S, and, upon receiving a load signal Load, outputs the stored video data signals to the pixel array 150 through the buffers.

The timing controller 120 may output 1 horizontal line of video data signals during four time slots by means of the data drive ICs DIC #1 to DIC #4.

Figure 6:
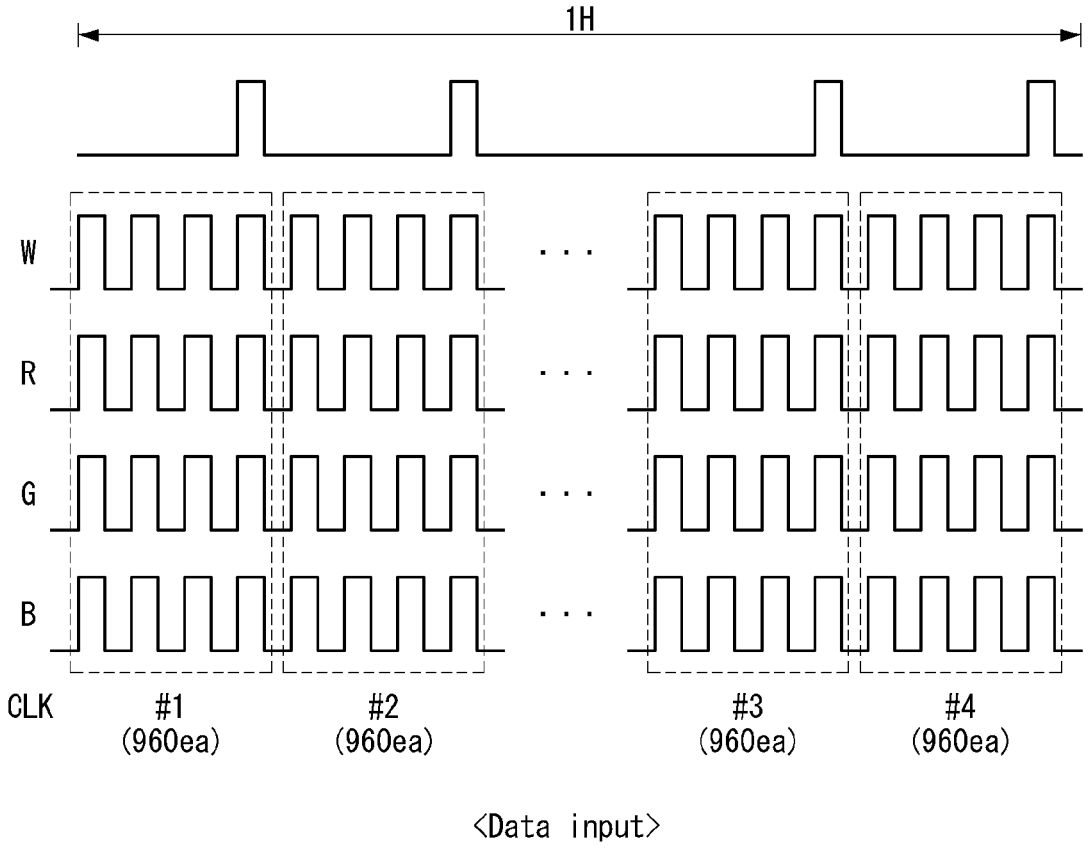
FIGS. 6 to 9 are signal waveform diagrams for explaining a method of driving a display device according to an exemplary embodiment of the present invention.

FIG. 6 is a view for explaining a method of how the timing controller 120 outputs digital video data. Referring to FIG. 6, the timing controller 120 may divide 1 horizontal line H of W/R/G/B digital video data into four parts and store the four parts separately in the line memories 123 and 124 (see FIG. 3). If the resolution of the horizontal line H is 3,840 signals, the digital video data may be divided by 960 (960ea). The timing controller 120 outputs the digital video data to the data drive ICs DIC #1 to DIC #4 respectively in accordance with 1/4H horizontal signals CLK1(#1), CLK2 (#2), CLK3(#3), and CLK4(#4).

Figure 7:
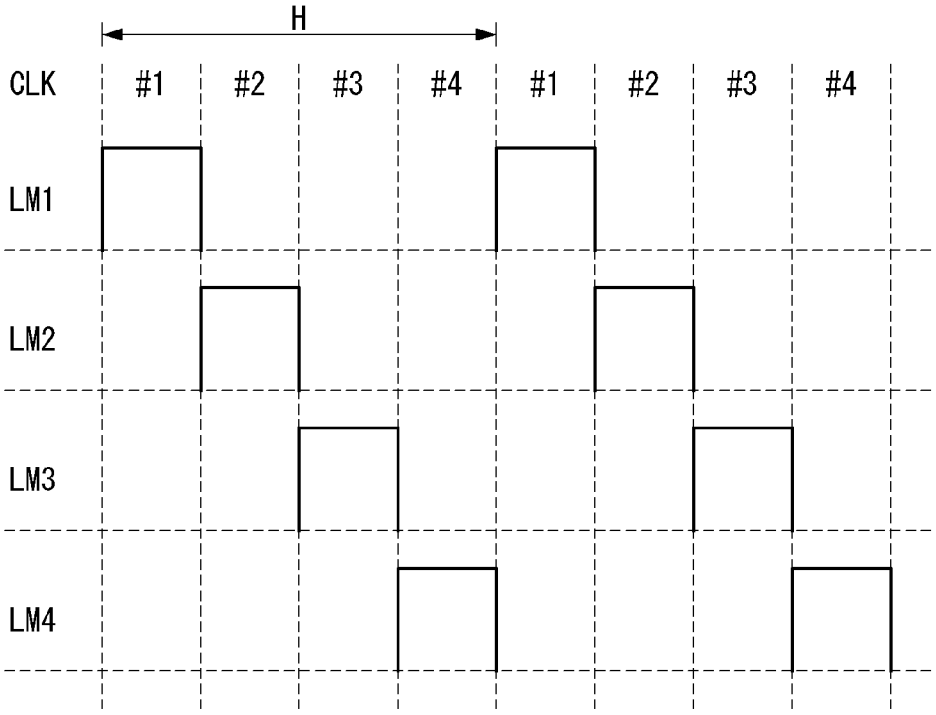

FIG. 7 is a waveform diagram of the transmission of four 1/4 parts of digital video data LM1, LM2, LM3, and LM4 stored in the line memories 123 and 124 (see FIG. 3). The digital video data LM1, LM2, LM3, and LM4 stored in the line memories 123 and 124 (see FIG. 3) of the timing controller 120 are sequentially outputted in accordance with the 1/4H horizontal signals CLK1(#1), CLK2(#2), CLK3(#3), and CLK4(#4).

The first data LM1 stored in a line memory is transmitted in response to CLK1(#1) corresponding to a 1/4H time, LM2 is transmitted in response to CLK2(#2) corresponding to a 2/4H time, LM3 is transmitted in response to CLK3(#3) corresponding to a 3/4H time, and LM4 is transmitted in response to CLK4(#4) corresponding to a 4/4H time.

Figure 8:
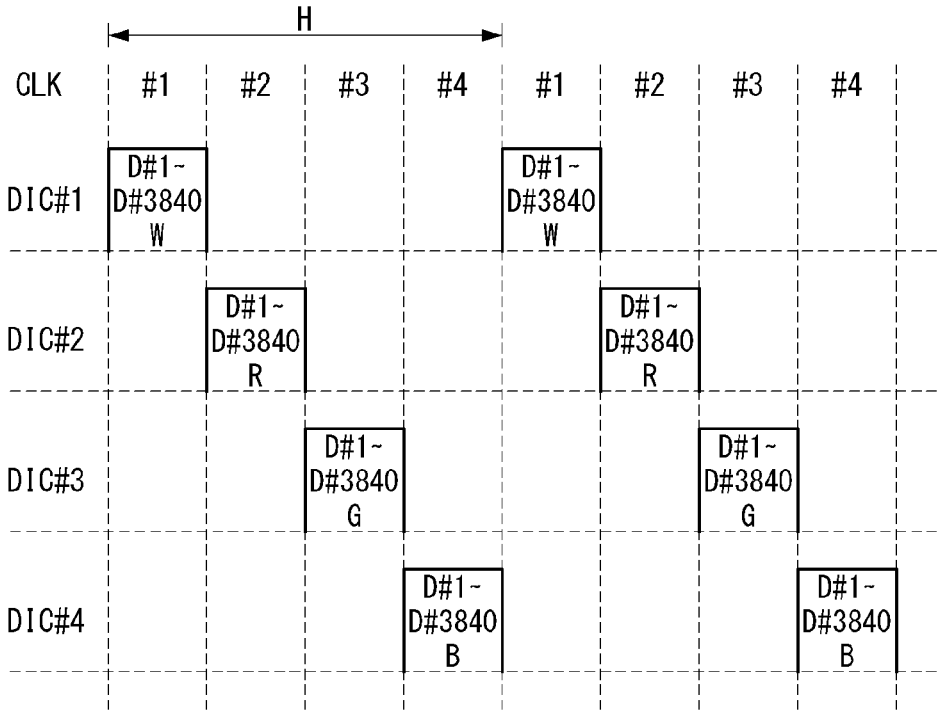
Figure 9:
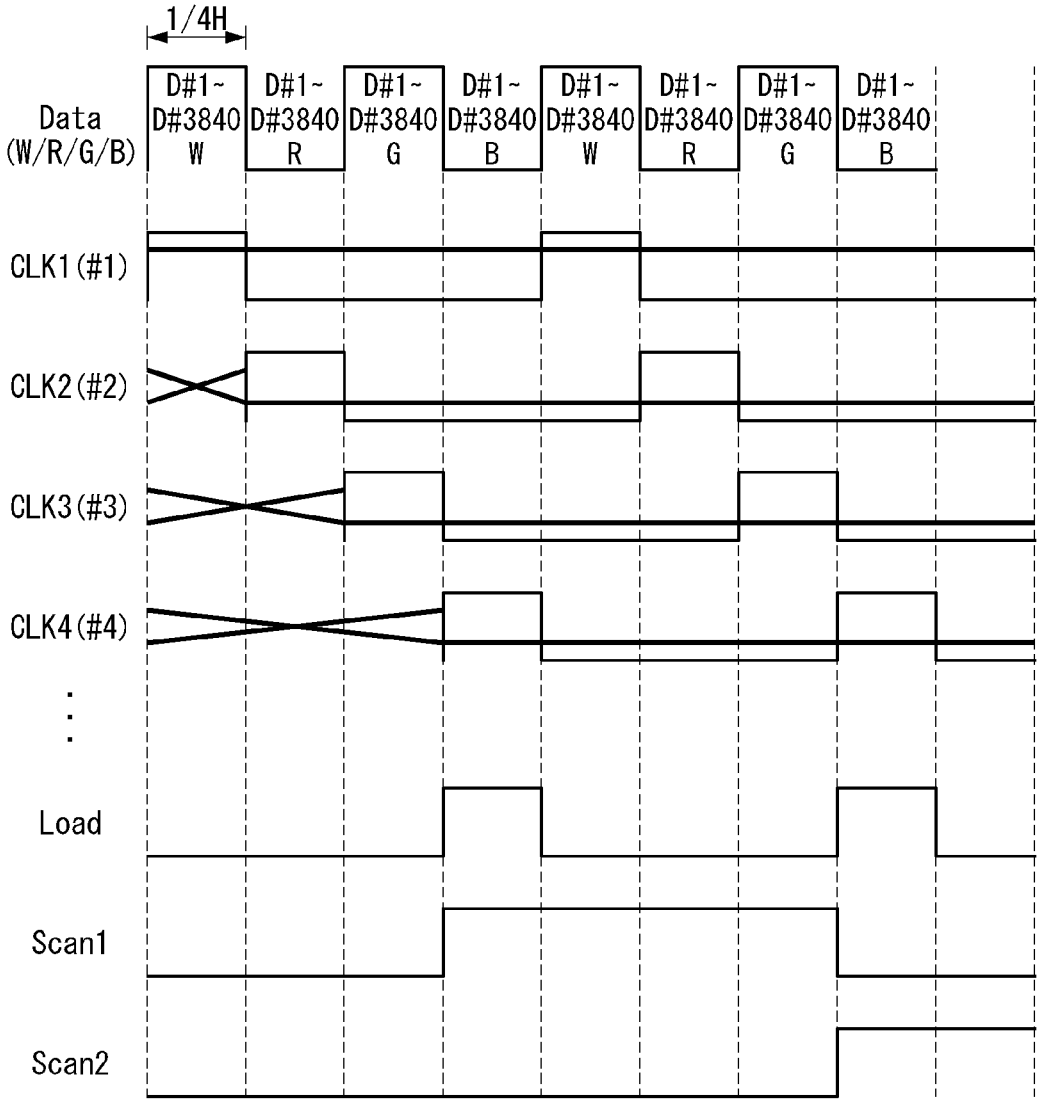

FIG. 8 shows operating waveforms of the data drive ICs DIC #1 to DIC #4. FIG. 9 shows operating waveforms of the latch part 200 and pixel array 150 in response to outputs of the data drive ICs.

Referring to FIGS. 8 and 9, DIC #1, DIC #2, DIC #3, and DIC #4 sequentially output data in accordance with 1/4H horizontal signals CLK1(#1), CLK2(#2), CLK3(#3), and CLK4(#4), respectively.

DIC #1 outputs W video data signals of D #1 to D #3804 in accordance with CLK1(#1) corresponding to a 1/4H time, and, upon receipt of CLK1(#1), the sampling latches S receive the W video data signals of D #1 to D #3804 and store them in the hold latches H.

DIC #2 outputs R video data signals of D #1 to D #3804 in accordance with CLK2(#2) corresponding to a 2/4H time, and, upon receipt of CLK2(#2), the sampling latches S receive the R video data signals of D #1 to D #3804 and store them in the hold latches H.

DIC #3 outputs G video data signals of D #1 to D #3804 in accordance with CLK3(#3) corresponding to the 3/4H time, and, upon receipt of CLK3(#3), the sampling latches S receive the G video data signals of D #1 to D #3804 and store them in the hold latches H.

DIC #4 outputs B video data signals of D #1 to D #3804 in accordance with CLK4(#4) corresponding to a 4/4H time, and, upon receipt of CLK4(#4), the sampling latches S receive the B video data signals of D #1 to D #3804 and store them in the hold latches H. Accordingly, 1 horizontal line of WRGB video data signals are stored in the hold latches H.

Moreover, a Load signal is inputted to the hold latches H in synchronization with CLK4(#4), and a Scan1 signal of the gate timing control signal GDC is inputted to a gate line GL on the pixel array 150. Upon receipt of the Load signal, the WRGB video data signals stored in the hold latches H are outputted to data lines DL. Upon receipt of the Scan1 signal, 1 horizontal line of sub-pixels connected to the corresponding gate line GL are selected, and the video data signals inputted to the data lines DL are stored in the selected sub-pixels.

As explained above, in the present invention, the latch part 200 is formed, together with the pixel array 150, within the panel PNL, and the latch part 200 stores and aligns N video data signals which are received separately during N time slots, combines them into a video data signal corresponding to 1 horizontal line, and outputs it to the pixel array 150. That is, instead of reducing the number of data drive ICs, 1/N of a video data signal corresponding to 1 horizontal line is transmitted N times, and the divided parts of the video data signal are realigned in the latch part 200 in the panel PNL and outputted to the pixel array 150. With this configuration, even if the number of data drive ICs is reduced, the pixel array 150 on the panel PNL may run at the same frequency with the same structure as the conventional art.

While the foregoing description has been given with respect to an exemplary embodiment in which there are four data drive ICs and WRGB data is divided into four parts, outputted at every 1/4H time interval, and stored and realigned, various design changes can be made, including the number of data drive ICs, the ratio in which data is split, the data output times, and the configuration of sub-pixels.

Although exemplary embodiments of the present invention have been described above with reference to the accompanying drawings, it should be understood that those skilled in the art may embody the technical configuration in other specific forms without changing the technical spirit and essential features of the present invention. Therefore, it should be understood that the embodiments described above are exemplary and not restrictive in all aspects, and the scope of the present invention is defined by the appended claims rather than the above specific descriptions. It should be interpreted that all the changed and modified forms derived from the meaning, scope and equivalent concepts of the claims are included in the scope of the present invention.

What is claimed is:

1. A display device comprising:

a panel comprising a pixel array and a latch part;

a data driver for outputting analog video data signals to the panel;

wherein the data driver comprises a plurality of data drive ICs sequentially outputting the analog video data signals during one horizontal period, wherein the latch part is disposed on the panel, comprises a plurality of latch blocks each including a sampling latch and a hold latch, receives the analog video data signals from the data driver and outputs the received analog video data signals to the pixel array, wherein one data driver IC is connected to N latch blocks (N is a natural number of 2 or more), and sequentially outputs 1/N analog video data signals during each 1/N horizontal period of the one horizontal period to the N latch blocks, and wherein each of N latch blocks sequentially receives the 1/N analog video data signals during different 1/N horizontal period of the one horizontal period.

2. The display device of claim 1, wherein the latch part aligns the analog video data signals corresponding to the one horizontal line of the pixel array.

3. The display device of claim 2, wherein each of the plurality of latch blocks outputs the analog video data signals of one full horizontal line stored during the one horizontal period to data lines on the pixel array.

4. The display device of claim 3, wherein, when N is 4, a first latch block of 4 latch blocks stores analog video data signals of a first color during a 1/4th horizontal period, a second latch block of the 4 latch blocks stores analog video data signals of a second color during a 2/4th horizontal period, a third latch block of the 4 latch blocks stores analog video data signals of a third color during a 3/4th horizontal period, and a fourth latch block of the 4 latch blocks stores analog video data signals of a fourth color during a 4/4th horizontal period, and the 4 latch blocks output the stored analog video data signals of the first, second, third, and fourth colors aligned.

5. The display device of claim 1, wherein each of the plurality of latch blocks comprises:

the sampling latch which sequentially receives and outputs the analog video data signals;

the hold latch which sequentially stores the analog video data outputted from the sampling latch and outputs the stored analog video data upon receipt of a load signal; and a buffer which delivers the outputs of the hold latch to a data line on the pixel array.

6. The display device of claim 1, further comprising a timing controller that time-divides 1 horizontal line of digital video data into N parts, stores each part as 1/N digital video data, and outputs the 1/N digital video data to the data driver in synchronization with a corresponding 1/N horizontal period.

7. The display device of claim 6, wherein the data driver converts the 1/N digital video data to the analog video data signals and outputs the analog video data signals to the latch part.

8. A method of driving a display device, the method comprising:

outputting digital video data from a timing controller to a plurality of data drive ICs included in a data driver;

converting the received digital video data to analog video data signals and sequentially outputting the analog video data signals during one horizontal period by each of the plurality of data drive ICs; and receiving and storing the analog video data signals and outputting the analog video data signals to a pixel array of a display panel by a latch part disposed on the display panel and comprising a plurality of latch blocks each including a sampling latch and a hold latch, wherein one data driver IC is connected to N latch blocks (N is a natural number of 2 or more), wherein sequentially outputting the analog video data signals during the one horizontal period by each of the plurality of data drive ICs comprises:

sequentially outputting 1/N analog video data signals during each 1/N horizontal period of the one horizontal period to the N latch blocks, and wherein receiving and storing of the analog video data signals and outputting the analog video data signals to the pixel array by the latch part comprises:

sequentially receiving the 1/N analog video data signals during different 1/N horizontal period of the one horizontal period by each of N latch blocks.

9. The method of claim 8, wherein the outputting of digital video data from the timing controller to the plurality of data drive ICs included in the data driver comprises:

time-dividing 1 horizontal line of digital video data into N parts and storing each part as 1/N digital video data; and outputting the 1/N digital video data to the data driver in synchronization with a corresponding 1/N horizontal period.

10. The method of claim 8, wherein the receiving and storing of the analog video data signals and outputting the analog video data signals to the pixel array by the latch part further comprises:

outputting the analog video data signals corresponding to one horizontal line of the pixel array aligned.

* * * * *